US008035566B2

(12) United States Patent
Tsai et al.

(10) Patent No.: US 8,035,566 B2
(45) Date of Patent: Oct. 11, 2011

(54) MULTI-BAND ANTENNA

(75) Inventors: Yung-Chih Tsai, Tu-Cheng (TW); Jia-Hung Su, Tu-Cheng (TW); Kai Shih, Tu-Cheng (TW); Yu-Yuan Wu, Tu-Cheng (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 395 days.

(21) Appl. No.: 12/436,125

(22) Filed: May 6, 2009

(65) Prior Publication Data

US 2010/0283685 A1 Nov. 11, 2010

(51) Int. Cl.
*H01Q 1/24* (2006.01)

(52) U.S. Cl. ..... 343/702; 343/700 MS; 343/846

(58) Field of Classification Search ..... 343/700 MS, 343/702, 829, 846
See application file for complete search history.

(56) References Cited

U.S. PATENT DOCUMENTS

| | | | | |
|---|---|---|---|---|
| 6,246,371 | B1 * | 6/2001 | Kurz et al. | 343/702 |
| 6,639,560 | B1 * | 10/2003 | Kadambi et al. | 343/700 MS |
| 6,861,986 | B2 * | 3/2005 | Fang et al. | 343/700 MS |
| 7,292,194 | B2 * | 11/2007 | Tai et al. | 343/702 |
| 7,362,277 | B2 * | 4/2008 | Su | 343/702 |
| 7,429,955 | B2 * | 9/2008 | Tai et al. | 343/702 |
| 7,466,272 | B1 * | 12/2008 | Su et al. | 343/700 MS |

* cited by examiner

*Primary Examiner* — Tho G Phan

(57) ABSTRACT

A multi-band antenna has a grounding plate with a first end and a second end defined at a longer side thereof. The longer side has an upward first connecting portion adjacent to the first end and a vertical second connecting portion. A feeding portion extends downwards from a lower edge of the second connecting portion. A first antenna radiator extends towards a same direction with respect to the second connecting portion along the grounding plate from an upper side of the second connecting portion. A second antenna radiator includes a first radiating portion, a second radiating portion and a third radiating portion. A third antenna radiator extends parallel to the first radiating portion from a side of the feeding portion. A coupling component includes a first section, a second section and a third section extending opposite to the first section from an end of the second section.

6 Claims, 6 Drawing Sheets

| | | | | |
|---|---|---|---|---|
| 1 | 824MHz | 96.767 Ω | 43.694 Ω | 8.439nH |
| 2 | 960MHz | 26.284 Ω | −8.061 Ω | 20.568pF |
| 3 | 1575MHz | 49.271 Ω | 2.808 Ω | 283.71pH |
| 4 | 1.71GHz | 59.414 Ω | 29.240 Ω | 2.721 nH |
| 5 | 2.17GHz | 32.815 Ω | 0.2289 Ω | 16.792pH |

| | | |
|---|---|---|
| Mkr1 | 824MHz | 2.469 |
| Mkr2 | 960MHz | 2.031 |
| Mkr3 | 1.57GHz | 1.062 |
| Mkr4 | 1.71GHz | 1.575 |
| Mkr5 | 2.17GHz | 1.539 |

| | | |
|---|---|---|
| Mkr1 | 824MHz | -7.751dB |
| Mkr2 | 960MHz | -9.385dB |
| Mkr3 | 1.75GHz | -31.518dB |
| Mkr4 | 1.71GHz | -11.277dB |
| Mkr5 | 2.17GHz | -13.643dB |

| | frequency (MHZ) | Efficiency(%) | Average Efficiency(%) |
|---|---|---|---|
| GSM850 | 824 | 31.26 | 38.94 |
| | 836 | 33.50 | |
| | 849 | 38.19 | |
| | 869 | 41.69 | |
| | 880 | 44.26 | |
| | 894 | 44.77 | |
| GSM900 | 900 | 45.71 | 43.19 |
| | 915 | 43.85 | |
| | 925 | 43.75 | |
| | 940 | 42.95 | |
| | 960 | 38.64 | |
| GPS | 1565 | 36.97 | 35.78 |
| | 1575 | 36.03 | |
| | 1585 | 34.35 | |
| DCS | 1710 | 41.69 | 33.98 |
| | 1750 | 36.14 | |
| | 1785 | 31.19 | |
| | 1805 | 29.92 | |
| | 1840 | 31.77 | |
| | 1850 | 33.27 | |
| | 1880 | 33.19 | |
| PCS | 1910 | 33.50 | 33.17 |
| | 1920 | 33.04 | |
| | 1930 | 33.50 | |
| | 1950 | 33.42 | |
| | 1960 | 33.50 | |
| | 1980 | 32.43 | |
| | 1990 | 32.06 | |
| WCDMA | 2110 | 30.09 | 33.14 |
| | 2140 | 34.59 | |
| | 2170 | 34.43 | |

FIG. 6

MULTI-BAND ANTENNA

BACKGROUND OF THE INVENTION

1. Field of the Invention

The invention relates to a multi-band antenna, and particularly to a multi-band antenna with a compact structure capable of covering multiple frequency bands.

2. The Related Art

With the development of electronic technology, a portable communication electronic device is generally equipped with many antennas for supporting wireless communication in multiple operating frequency bands, such as the bands of Global Position System (GPS), wireless wide area network (WWAN) and the like, nowadays. Accordingly, it makes the electronic device occupy a relatively large space to receive the corresponding antennas, which is against the current trends of light and compact electronic device; furthermore, it increases the manufacturing cost and the assembling time. So it is necessary to design an antenna with a compact structure capable of covering the above-mentioned frequency bands synchronously.

SUMMARY OF THE INVENTION

An object of the present invention is to provide a multi-band antenna with a compact structure capable of covering multiple frequency bands.

The multi-band antenna has an elongated grounding plate disposed levelly with a first end and a second end defined at a longer side thereof. The longer side has an upward first connecting portion adjacent to the first end and a vertical second connecting portion extending along the longer side and opposite to the first end from an upper portion of the first connecting portion and being spaced away from the grounding plate. A feeding portion extends downwards from a lower edge of the second connecting portion, and is spaced away from the grounding plate. A first antenna radiator extends towards a same direction with respect to the second connecting portion along the grounding plate from an upper side of the second connecting portion. The first antenna radiator is parallel to the grounding plate and elongated along an extending direction of the grounding plate. A second antenna radiator includes a first radiating portion extended towards the second end from a side of the second connecting portion facing the second end and longer than the first antenna radiator, a second radiating portion extended upwards from a free end of the first radiating portion, and a third radiating portion prolonged opposite to the first radiating portion from a top end of the second radiating portion. The third radiating portion is substantially flush and aligned with the first antenna radiator. A third antenna radiator extends parallel to the first radiating portion from a side of the feeding portion extending toward the second end. A coupling component connected with the second end of the longer side includes a first section extending towards the third radiating portion, with a top edge lower than the third radiating portion, a second section extending perpendicularly and away from the third radiating portion from a free end of the first section, and a third section extending opposite to the first section from a free end of the second section and beyond the third radiating portion.

As described above, the first antenna radiator, the second antenna radiator, the third antenna radiator and the coupling component are adapted for generating electromagnetic resonance in frequency bands ranging from 1710 MHz to 2170 MHz, from 824 MHz to 960 MHz and around 1575 MHZ, respectively. Thus the multi-band antenna is capable of receiving and sending electromagnetic signals in GSM850 (824~894 MHZ), GSM900 (880~960 MHZ), GPS (1575±10 MHZ), DCS (1710~1880 MHZ), PCS (1850~1990 MHZ) and W-CDMA 2100 (1920~2170 MHZ). Therefore, the multi-band antenna covering multiple frequency bands mainly used in the world will meet the using demands from customers and be inclined to be applied widely.

BRIEF DESCRIPTION OF THE DRAWINGS

The present invention will be apparent to those skilled in the art by reading the following description thereof, with reference to the attached drawings, in which:

FIG. 6 shows an Antenna Performance test chart of the multi-band antenna shown in FIG. 1.

DETAILED DESCRIPTION OF THE PREFERRED EMBODIMENT

Figure 1:
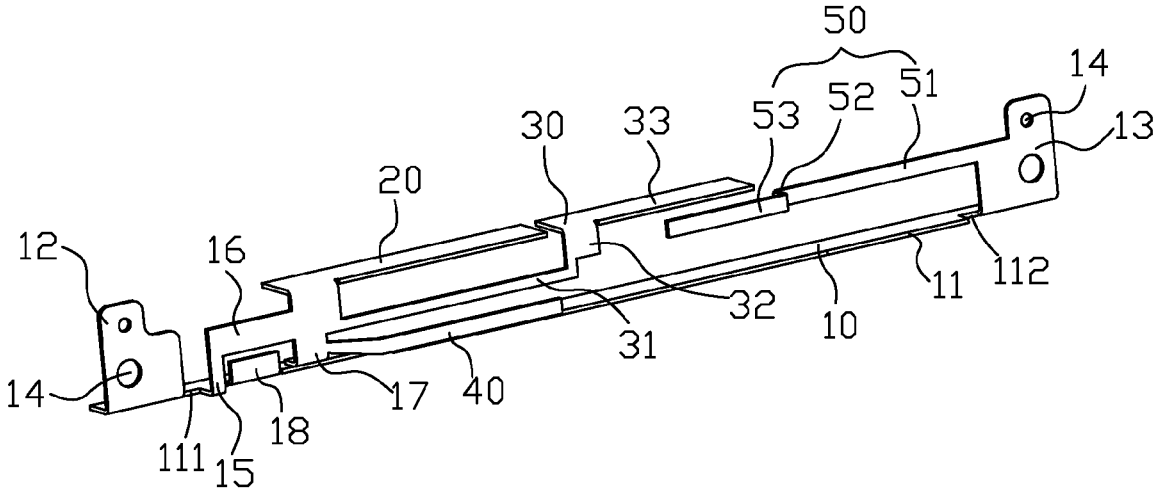
FIG. 1 is a perspective view of a multi-band antenna according to an embodiment of the present invention.
Figure 2:
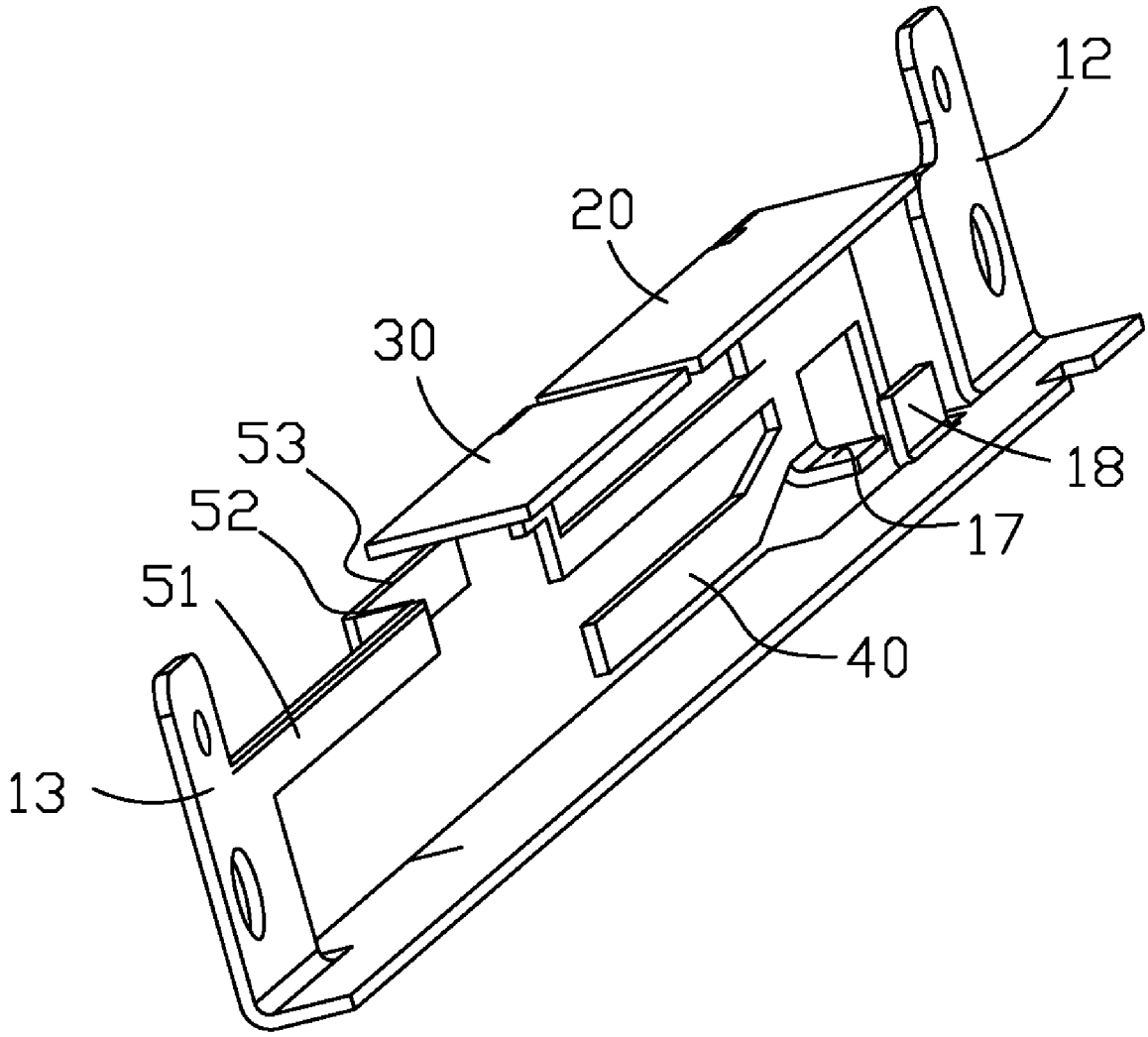
FIG. 2 is a perspective view of the multi-band antenna shown in FIG. 1 seen from another direction.

Please refer to FIG. 1 and FIG. 2, a multi-band antenna according to the present invention is shown. The multi-band antenna mounted on an electronic device (not shown) has an elongated grounding plate 10 disposed levelly with a longer side 11 defined thereon. Both opposite ends of the longer side 11 is defined a first end 111 and a second end 112. The first end 111 and the second end 112 are both extended upwards to form a first positioning plate 12 and a second positioning plate 13. Each of the first positioning plate 12 and the second positioning plate 13 has two positioning holes 14, convenient for assembly. An upward first connecting portion 15 is extended outwards from a portion of the longer side 11 adjacent to the first positioning plate 12 and bent upwards to show an L-shape. A vertical second connecting portion 16 is extended opposite to the first positioning plate 12 along the longer side 11 from an upper portion of the first connecting portion 15. The second connecting portion 16 is of L-shape, having an upwardly oriented end, and spaced away from the grounding plate 10. A feeding portion 17 extends downwards from a lower edge of the second connecting portion 16, with a bent bottom adjacent to and spaced apart from the grounding plate 10. A soldering portion 18 extends upwards from a portion of the longer side 11 of the grounding plate 10 between the first connecting portion 15 and the feeding portion 17, and is spaced away from the first and the second connecting portions 15, 16 with a predetermined distance for generating coupling effect therebetween, enlarging frequency width of the multi-band antenna. The soldering portion 18 is biased from the second connecting portion 16 and adapted for soldering a cable (not shown) thereon. A first antenna radiator 20 extends towards a same direction with respect to the second connecting portion 16 along the grounding plate 10 from an upper side of the oriented end of the second connecting portion 16. The first antenna radiator 20 is parallel to the grounding plate 10 and elongated along an extending direction of the grounding plate 10. A second antenna radiator 30 includes a first radiating portion 31 extended towards the second positioning plate 13 from a lower portion of a side of the second connecting portion 16 facing the second end 112 and longer than the first antenna radiator 20, a second radiating portion 32 extended upwards from a free end of the first radiating portion 31, and a third radiating portion 33 prolonged levelly and opposite to the first radiating portion 31 from a top edge of the second radiating portion 32. The third radiating portion 33 is substantially flush and aligned with the first antenna radiator 20. A third antenna radiator 40 extending from a side of the feeding portion 17 protrudes slantingly and downwardly toward the second end 112, and then extends parallel to the first radiating portion 31. A bottom edge and a free end of the third antenna radiator 40 are respectively and substantially flush with the grounding plate 10 and a free end of the first antenna radiator 20. A coupling component 50 includes a first section 51 extended towards the third radiating portion 33 of the second antenna radiator 30 from a side of the second positioning plate 13 facing the first positioning plate 12, with a top edge lower than the third radiating portion 33 and a free end spaced from the third radiating portion 33 with a short distance, a second section 52 extended perpendicularly and away from the third radiating portion 33 from a free end of the first section 51, and a third section 53 extended perpendicularly and opposite to the first section 51 from a free end of the second section 52 and beyond the third radiating portion 33.

When the multi-band antenna operates at wireless communication, a current is fed from the feeding portion 17 to the first antenna radiator 20 to generate an electrical resonance corresponding to frequency band ranging between 1.71 GHz and 2.17 GHz. While the current is fed from the feeding portion 17 to the second antenna radiator 30 to generate an electrical resonance corresponding to frequency band ranging between 824 MHz and 960 MHz. Meanwhile, the first antenna radiator 20, the second antenna radiator 30 and the third antenna radiator 40 have influence upon each other, so that the electrical resonance according to the frequency bands are superimposed, consequently, enlarging bandwidth of a high frequency. The coupling portion 50 and the third radiating portion 33 of the second antenna radiator 30 generate coupling effect therebetween, which can generate an electrical resonance corresponding to frequency band of 1575 MHZ.

Figure 3:
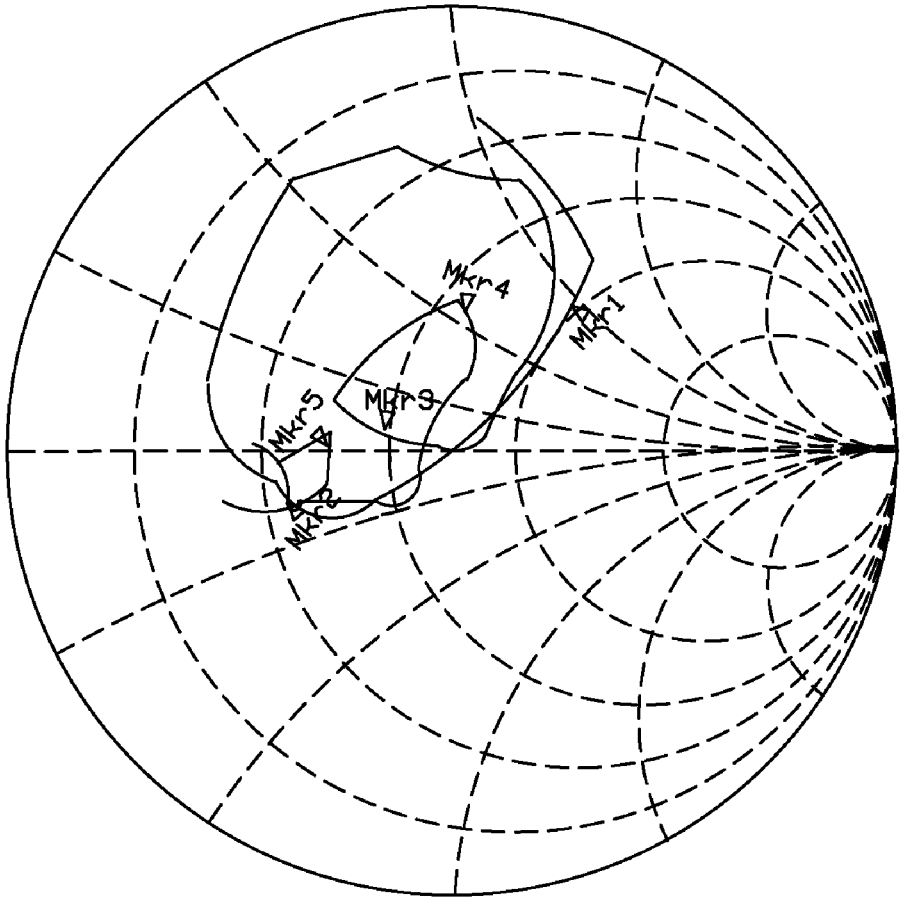
FIG. 3 is a Smith chart recording impedance of the multi-band antenna shown in FIG. 1.

Please refer to FIG. 3, which shows a Smith chart recording impedance of the multi-band antenna when the multi-band antenna operates at wireless communication. The multi-band antenna exhibits an impedance of (96.767+j43.694) Ohm at 824 MHz, an impedance of (26.284−j8.061) Ohm at 960 MHz, an impedance of (49.271+j2.808) Ohm at 1575 MHz, an impedance of (59.414+29.240) Ohm at 1710 MHz, an impedance of (32.815+j0.2289) Ohm at 2170 MHz. Therefore, the multi-band antenna has good impedance characteristics.

Figure 4:
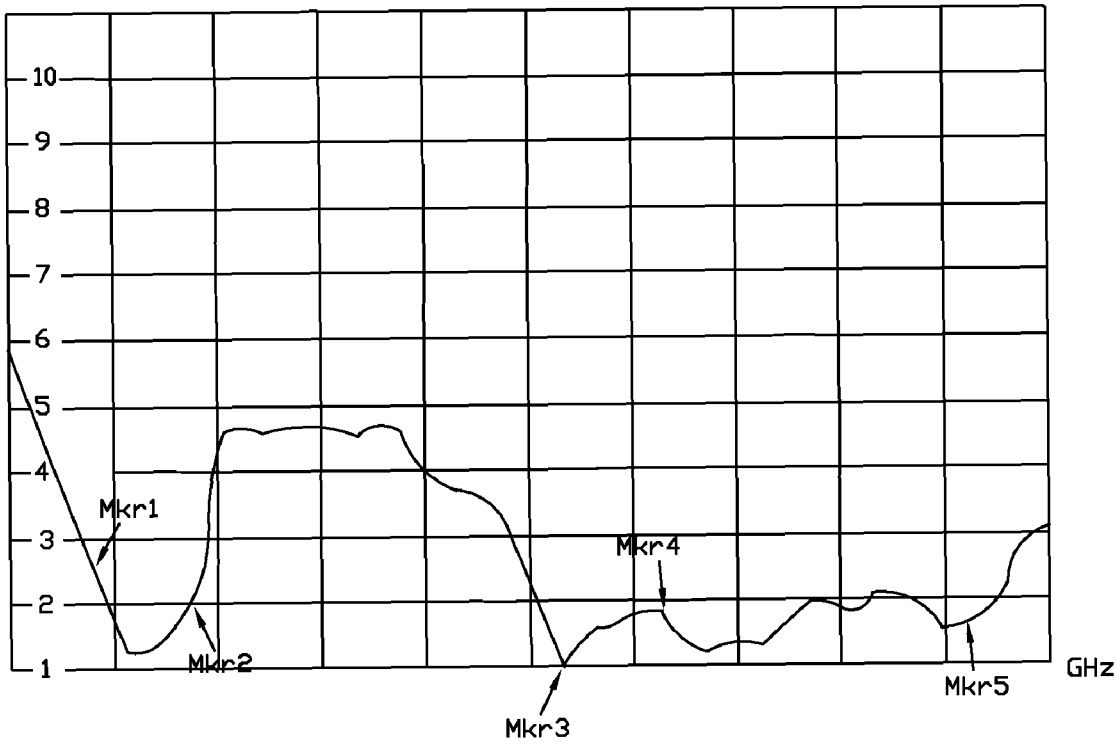
FIG. 4 shows a Voltage Standing Wave Ratio (VSWR) test chart of the multi-band antenna shown in FIG. 1.

Please refer to FIG. 4, which shows a Voltage Standing Wave Ratio (VSWR) test chart of the multi-band antenna when the multi-band antenna operates at wireless communication. When the multi-band antenna operates at 824 MHz (indicator Mkr1 in FIG. 4), the VSWR value is 2.469. When the multi-band antenna operates at 960 MHz (indicator Mkr2 in FIG. 4), the VSWR value is 2.031. When the multi-band antenna operates at 1575 MHz (indicator Mkr3 in FIG. 4), the VSWR value is 1.062. When the multi-band antenna operates at 1.71 GHz (indicator Mkr4 in FIG. 4), the VSWR value is 1.575. When the multi-band antenna operates at 2.17 GHz (indicator Mkr5 in FIG. 4), the VSWR value is 1.539. The VSWR values of the multi-band antenna show that the multi-band antenna has an excellent frequency response between 825 MHz~960 MHz, between 1.71 GHz~2.17 GHz, and 1575 MHZ.

Figure 5:
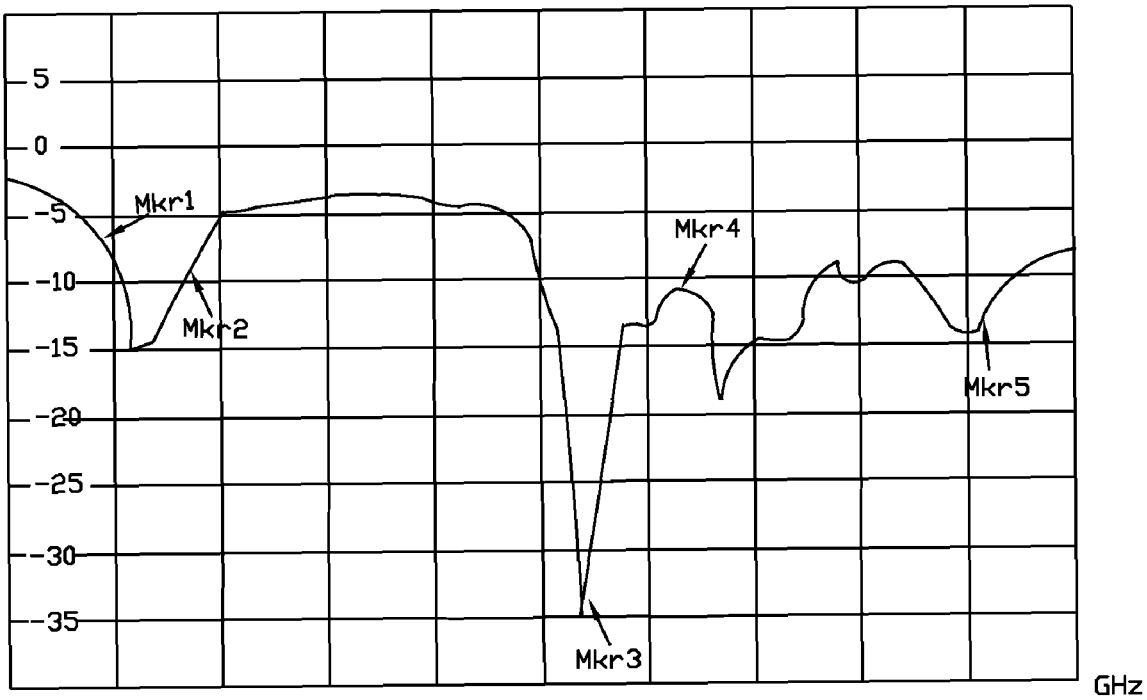
FIG. 5 shows a Return Loss test chart of the multi-band antenna shown in FIG. 1.

Please refer to FIG. 5, which shows a Return Loss test chart of the multi-band antenna when the multi-band antenna operates at wireless communication. When the multi-band antenna operates at 824 MHz (indicator Mkr1 in FIG. 5), the return loss value is −7.751 dB. When the multi-band antenna operates at 960 MHz (indicator Mkr2 in FIG. 5), the return loss value is −9.385 dB. When the multi-band antenna operates at 1575 MHz (indicator Mkr3 in FIG. 5), the return loss value is −31.518 dB. When the multi-band antenna operates at 1.71 GHz (indicator Mkr4 in FIG. 5), the return loss value is −11.277 dB. When the multi-band antenna operates at 2.17 GHz (indicator Mkr5 in FIG. 5), the return loss value is −13.643 dB. The return loss values of the multi-band antenna show that the multi-band antenna has an excellent frequency response between 825 MHz~960 MHz and between 1.71 GHz~2.17 GHz and 1575 MHZ.

Please refer to FIG. 6, which shows an efficient chart of the multi-band antenna in the embodiment. When the multi-band antenna receives and sends electromagnetic signals in GSM 850 (824~894 MHZ), the average antenna efficient is 38.94%. When the multi-band antenna receives and sends electromagnetic signals in GSM 900 (880~960 MHZ), the average antenna efficient is 43.19%. When the multi-band antenna receives and sends electromagnetic signals in GPS (1575±10 MHZ), the average antenna efficient is 35.78%. When the multi-band antenna receives and sends electromagnetic signals in DCS (1710~1880 MHZ), the average antenna efficient is 33.98%. When the multi-band antenna receives and sends electromagnetic signals in PCS (1850~1990 MHZ), the average antenna efficient is 33.17%. When the multi-band antenna receives and sends electromagnetic signals in W-CDMA 2100 (1920~2170 MHZ), the average antenna efficient is 33.14%. The average antenna efficient shows that the multi-band antenna has a good performance in the low frequency and the high frequency.

As described above, the structure of the multi-band antenna is simple and compact. The first antenna radiator 20, the second antenna radiator 30, the third antenna radiator 40 and the coupling component 50 are capable of covering frequency bands between 824 MHZ and 960 MHZ, between 1710 MHZ and 2170 MHZ and around 1575 MHZ, which makes the multi-band antenna capable of receiving and sending electromagnetic signals in GSM850 (824~894 MHZ), GSM900 (880~960 MHZ), GPS (1575±10 MHZ), DCS (1710~1880 MHZ), PCS (1850~1990 MHZ) and W-CDMA 2100 (1920~2170 MHZ). Therefore, the multi-band antenna covering multiple frequency bands mainly used in the world and occupying a less space will meet the using demands from customers and be inclined to be applied widely.

Furthermore, the present invention is not limited to the embodiment described above; various additions, alterations and the like may be made within the scope of the present invention by a person skilled in the art. For example, respective embodiments may be appropriately combined.

What is claimed is:

1. A multi-band antenna, comprising:

an elongated grounding plate disposed levelly with a first end and a second end defined at a longer side thereof, the longer side having an upward first connecting portion adjacent to the first end, a vertical second connecting portion extending along the longer side and opposite to the first end from an upper portion of the first connecting portion and being spaced away from the grounding plate;

a feeding portion extending downwards from a lower edge of the second connecting portion, and spaced away from the grounding plate;

a first antenna radiator extended towards a same direction with respect to the second connecting portion along the grounding plate from an upper side of the second connecting portion, the first antenna radiator parallel to the grounding plate and elongated along an extending direction of the grounding plate;

a second antenna radiator, the second antenna radiator including a first radiating portion extended towards the second end from a side of the second connecting portion facing the second end and longer than the first antenna radiator, a second radiating portion extended upwards from a free end of the first radiating portion, and a third radiating portion prolonged opposite to the first radiating portion from a top end of the second radiating portion, the third radiating portion substantially flush and aligned with the first antenna radiator;

a third antenna radiator parallel to the first radiating portion and connected to a side of the feeding portion extending toward the second end; and a coupling component connected with the second end of the longer side and including a first section extending towards the third radiating portion, with a top edge lower than the third radiating portion, a second section extending perpendicularly and away from the third radiating portion from a free end of the first section, and a third section extending opposite to the first section from a free end of the second section and beyond the third radiating portion.

2. The multi-band antenna as claimed in claim 1, wherein the longer side of the grounding plate has a portion extended outwards and bent upwards to form the first connecting portion of L shape, the second connecting portion is extended from an end of the first connecting portion, having an upwardly oriented end away from the first connecting portion to show an L-shape, the feeding portion with a bent bottom adjacent to the grounding plate is spaced away from the first connecting portion.

3. The multi-band antenna as claimed in claim 2, wherein the longer side of the grounding plate has a portion extended upwards to form a soldering portion between the first connecting portion and the feeding portion, the soldering portion is spaced from the first and second connecting portions with a predetermined distance.

4. The multi-band antenna as claimed in claim 1, wherein the first end and the second end of the longer side are extended upwards to form a first positioning plate and a second positioning plate, respectively, each of which has two positioning holes for convenient assembly.

5. The multi-band antenna as claimed in claim 4, wherein the first section of the coupling component is extended from a side of the second positioning plate facing the first positioning plate.

6. The multi-band antenna as claimed in claim 1, wherein the third antenna radiator protrudes slantingly and downwardly a distance, and extends parallel to the first radiating portion, a bottom edge and a free end of third antenna radiator are respectively and substantially flush with the grounding plate and a free end of the first antenna radiator.

* * * * *